US005468303A

United States Patent [19]

Thomas, Sr.

[11] Patent Number: 5,468,303

[45] Date of Patent: Nov. 21, 1995

[54] RUST, CORROSION, AND SCALE REMOVER

[75] Inventor: Glenn C. Thomas, Sr., Cleveland, Ohio

[73] Assignee: ZT Corporation, Cleveland, Ohio

[21] Appl. No.: 201,744

[22] Filed: Feb. 25, 1994

[51] Int. Cl.[6] ..... C23F 15/00; C23F 14/00

[52] U.S. Cl. ..... 134/3; 252/2; 252/71; 252/68; 252/69; 252/70; 252/80; 252/82; 252/180

[58] Field of Search ..... 134/2, 3; 252/71, 252/68, 69, 70, 80, 82, 180, 389.22, 389.61, 389.62; 422/16

[56] References Cited

U.S. PATENT DOCUMENTS

| | | | |
|---|---|---|---|
| 1,554,483 | 9/1925 | Bailey | 134/28 |
| 1,729,766 | 10/1929 | Dinley | 134/28 |
| 2,318,559 | 5/1943 | Percival | 134/28 |
| 2,430,435 | 11/1947 | Sperry | 134/28 |
| 2,580,719 | 1/1952 | Barton | 106/33 |
| 2,666,000 | 1/1954 | Hoff | 134/27 |
| 3,003,896 | 10/1961 | Kendall | 134/28 |
| 3,095,862 | 7/1963 | Berner | 252/180 |
| 3,116,105 | 12/1963 | Kerst | 252/180 |
| 3,150,081 | 9/1964 | Haslam | 134/28 |
| 3,447,965 | 6/1969 | Teumac | 252/82 |
| 3,460,989 | 8/1969 | Rusch | 134/28 |
| 3,496,017 | 2/1970 | Weed | 134/28 |
| 3,639,278 | 1/1972 | Hwa | 252/180 |
| 3,639,279 | 1/1972 | Gardner et al. | 252/86 |
| 3,639,645 | 1/1972 | Miller | 252/82 |
| 3,664,870 | 5/1972 | Obehofer et al. | 134/22 X |
| 3,864,139 | 2/1975 | Heller | 106/287.19 |
| 4,190,463 | 2/1980 | Kaplan | 134/28 |
| 4,192,769 | 3/1980 | Jahnke | 252/389.2 |
| 4,246,030 | 1/1981 | Lipinski | 106/14.12 |
| 4,367,092 | 1/1983 | Unzens | 106/3 |
| 4,430,240 | 2/1984 | Sandvig et al. | 252/70 |
| 4,540,443 | 9/1985 | Barber | 252/80 |
| 4,595,517 | 6/1986 | Abadi | 252/180 |
| 4,720,306 | 1/1988 | Emmert et al. | 134/28 |
| 4,802,990 | 2/1989 | Inskeep, Jr. | 252/82 |
| 4,938,891 | 7/1990 | Lenack et al. | 252/493 |
| 5,015,298 | 5/1991 | Arrington | 134/28 |
| 5,021,096 | 6/1991 | Abadi | 252/82 |
| 5,023,011 | 6/1991 | Busch et al. | 252/80 |
| 5,071,582 | 12/1991 | Conville et al. | 252/80 |
| 5,084,105 | 1/1992 | Morris et al. | 252/180 |
| 5,093,020 | 3/1992 | Paul et al. | 252/180 |

OTHER PUBLICATIONS

Kirk–Othmer *Concise Encyclopedia of Chemical Technology,* Executive Editor, Martin Grayson, (John Wiley & Sons, New York, N.Y., 1985) p. 281 (Citric Acid); p. 631 (Hydroxyacetic Acid); p. 752 (Metal Surface treatments).

Hawley's Condensed Chemical Dictionary, 12th Edition, revised by Richard J. Lewis, Sr. (Van Nostrand Reinhold Company, New York, N.Y., 1993) p. 65 (ammonium citrate, dibasic).

Front and back labels from plastic container of Solder Seal/Gunk brand of *Super Heavy–Duty Radiator Cleaner,* sold in the United States prior to Aug. 23, 1993, by Radiator Specialty Company, Charlotte, N.C. 28234–6080 (ph. 704–377–6555).

*Primary Examiner*—Gary L. Geist
*Assistant Examiner*—Valerie Fee
*Attorney, Agent, or Firm*—Pearne, Gordon, McCoy & Granger

[57] ABSTRACT

A rust, corrosion, and scale removing composition is provided. It comprises an additive concentrate and water. The additive concentrate preferably consists of, on a parts by weight basis, 1.5 to 5 parts glycolic acid, 0.2 to 1 parts tetrasodium salt of ethylenediaminetetraacetic acid, 2 to 6 parts citric acid, and 1 to 3 parts trisodium citrate dihydrate.

13 Claims, No Drawings

RUST, CORROSION, AND SCALE REMOVER

BACKGROUND OF THE INVENTION

This invention relates generally to chemical compositions and more specifically to chemical compositions for use in removing rust, corrosion, and scale from ferrous metal, copper, brass, and other surfaces.

DISCUSSION OF RELATED ART

It has been known for some time to use various compositions as a rust remover to remove rust from ferrous metal, and as a radiator flush to remove scale and other deposits from inside a cooling system such as an automobile radiator. For example, U.S. Pat. No. 4,540,443 teaches an aqueous solution of a tetra-alkali metal salt of ethylenediaminetetraacetic acid (EDTA), a soluble salt of citric acid, and a soluble salt of nitric acid as a cooling system cleaning composition. Phosphoric acid is an active ingredient for rust removal purposes and hydrochloric acid is an active ingredient for use as an automobile radiator flush. Another known automobile radiator flush uses an aqueous solution of citric acid, tetrasodium EDTA, potassium citrate, and diethylene glycol butyl ether.

However, there has developed a need over the last several years for a rust and corrosion remover and radiator flush which is less hazardous, more biodegradable, and more environmentally friendly than those of the prior art. Less hazardous ingredients make the product safer for the consumer to handle and consumers prefer to buy products which are more biodegradable and environmentally friendly. Also, manufacturers want to use ingredients which are less regulated by Federal and State EPA authorities, less hazardous to employees handling in concentrated form, and which have reduced reporting, monitoring, permitting, and disposal requirements and constraints. There is also a need for a product which will work effectively as both a rust and corrosion remover and a radiator flush thus eliminating the need for separate formulations for each task. These needs are met by the present invention.

SUMMARY OF THE INVENTION

There is provided a rust, corrosion, and scale removing composition for use in removing rust, corrosion, and scale from steel, iron, copper, brass, bronze, and other surfaces. The composition comprises an additive concentrate and water, the additive concentrate preferably consisting of, on a parts by weight basis, 1.5 to 5 parts glycolic acid, 0.2 to 1 parts tetrasodium salt of ethylenediaminetetraacetic acid, 2 to 6 parts citric acid, and 1 to 3 parts trisodium citrate dihydrate, said composition being an aqueous solution.

DETAILED DESCRIPTION OF THE PREFERRED EMBODIMENTS

As used in the specification and claims, ferrous metal includes steel and iron. Rust is a common corrosion product on a ferrous metal surface. Verdigris is a common corrosion product on a surface of copper, brass, or bronze. Unless otherwise specified, parts are on a parts by weight basis.

The composition of the present invention preferably comprises an additive concentrate and water. The additive concentrate preferably consists of, on a parts by weight basis, 1.5 to 5, preferably 2.8, parts glycolic acid (hydroxyacetic acid), 0.2 to 1, preferably 0.4, parts tetrasodium salt of ethylenediaminetetraacetic acid (tetrasodium EDTA), 2 to 6, preferably 4, parts citric acid, and 1 to 3, preferably 2, parts trisodium citrate dihydrate, said composition being an aqueous solution. For use as a rust and corrosion remover, the composition preferably comprises from about 5 to about 15, more preferably about 9 to 10, weight percent of said additive concentrate and from about 85 to about 95, more preferably about 90, weight percent of water, the pH preferably being between about 2.5 and about 5.5, more preferably between about 3.5 and about 4.5, at 70° F., the pH preferably being adjusted by means commonly known in the art.

For use as a cooling system flush or cooling system scale remover, such as a radiator flush for an automobile, the more preferred composition used as a rust and corrosion remover, described above, is preferably diluted with water using preferably about 12 to about 18, more preferably about 15, parts water to 1 part of the more preferred rust and corrosion remover composition. A preferred radiator flush comprises from about 0.2 to about 1.5, more preferably about 0.6, weight percent of the preferred additive concentrate described above, and from about 98.5 to about 99.8, more preferably about 99.4, weight percent of water.

The formulations of the present invention are preferably used above 32° F. and preferably between about 50° F. and about 160° F., more preferably about 70° F. The formulations tend to work more quickly at higher temperatures and with agitation.

The rust remover composition is preferably prepared by mixing with equipment known in the art with agitation and recirculation at 70° F. in the following order: water, tetrasodium EDTA, citric acid, ammonium citrate (if used), trisodium citrate, and glycolic acid.

The composition of the present invention is preferably first made with a minimum amount of water, to minimize the storage space required and shipment costs. The composition can then be diluted with water and preferably repackaged to form the ready-to-use formulations. Thus the product which can be shipped can have a percentage of water anywhere from the minimum percentage needed for manufacture to the percentage present when used as a cooling system flush.

To use as a rust or corrosion remover, preferably the article is immersed in the composition or the composition is applied to the metal surface and is removed using techniques well known in the art after an effective period of time. To use as a cooling system flush, the cooling system is drained, the composition is added, and procedures well-known in the art are thereafter followed.

The formulations of the present invention are preferably free from the presence of nitric acid, nitric acid salts, and diethylene glycol butyl ether (DGBE). DGBE and nitric acid are included in the EPA SARA Title III, Sec. 313 toxic chemical list, while none of the ingredients of the present invention are so included. After use of the invented rust remover/radiator flush, any remaining acidity can be effectively neutralized with baking soda. It is believed that the formulations of the present invention are biodegradable, which is desirable.

The reasons for the excellent performance characteristics of the present invention are not fully understood, but it is believed that the presence of glycolic acid is particularly important and provides unique performance benefits when used in combination with the other ingredients.

In the examples below the following materials were used, all being available from Interstate Chemical Co., Inc., Pueblo West, Colo.

1. A solution of 70% glycolic acid (CAS Number 79-14-1)

and 30% water by weight (hereinafter glycolic acid-70% solution). This is a liquid.

2. Dissolvine E-39. This is a 39% by weight solution of the tetrasodium salt of ethylenediaminetetraacetic acid (CAS Number 64-02-8) in water.
3. Citric acid, anhydrous (hereinafter citric acid, CAS Number 77-92-9). This is a solid.
4. Trisodium citrate dihydrate (hereinafter trisodium citrate, CAS Number 68-04-2). This is a solid.
5. Dibasic ammonium citrate (hereinafter ammonium citrate, CAS Number 03012-65-5). This is a solid.

EXAMPLE 1

A formulation was prepared containing, on a parts by weight basis, 4 parts glycolic acid-70% solution, 1 part Dissolvine E-39, 4 parts citric acid, 1 part ammonium citrate, 2 parts trisodium citrate, and 88 parts water. The order of mixing was as follows: water, Dissolvine, citric acid, ammonium citrate, trisodium citrate, and glycolic acid, with agitation and recirculation at 70° F. The formulation mixed well and was very clear. It had a pH of 3.9 at 70° F. A sample about 250 ml was warmed to about 135° F. and used to remove via immersion about 3.5 sq. in. of rust from ferrous metal in approx. 10 minutes Without agitation and was then found to have a pH of 5.6 at 133° F.

EXAMPLE 2

The formulation of Example 1 was used to clean rusted scrap metal (ferrous metal) by immersion without agitation. When the formulation was hot (about 120°–160° F.) it cleaned the rust off in 5.7 minutes; when unheated (about 70° F.) it cleaned the rust off in 13.3 minutes.

EXAMPLE 3

The formulation of Example 1 was tested as a radiator flush. An old automobile radiator which was almost plugged up was tested. First the coolant was drained. The formulation of Example 1 was diluted 15 to 1 with water and the resulting solution was used to fill the radiator. The car was idled for about 30 minutes, circulating the solution through the cooling system to remove the scale from the interior surfaces of the cooling system. The radiator was then drained and upon inspection was seen to be clean when before it was almost plugged up.

EXAMPLE 4

The formulation of Example 1 was heated to about 160°–190° F. and was used to clean various copper and brass alloys at a scrap yard. It effectively cleaned off the corrosion but left the metal tarnished. However the tarnish was easily removed with a copper and brass polish.

EXAMPLE 5

Two sets of rusted steel strips were completely cleaned via immersion using the formulation of Example 1. The first set of strips was permitted to dry without rinsing off the solution. With regard to the second set of strips, the solution was washed and rinsed off before the strips were permitted to dry. Both sets of strips were then exposed to the air to dry. The second set reoxidized or rusted overnight. The first set did not start to reoxidize until 34 days had passed, thus showing that the dried solution provided some protection against rust.

EXAMPLE 6

A formulation was prepared containing, on a parts by weight basis, 4 parts glycolic acid-70% solution, 1 part Dissolvine E-39, 4 parts citric acid, 2 parts trisodium citrate, and 89 parts water. This formulation was tested using comparable rust and corrosion removal and radiator flush tests and was found to work equally well as the formation of Example 1. For example, four towmotor radiators which had approximately medium scale were tested and cleaned as in Example 3 with comparable results. Copper/brass alloy electrical connections were cleaned like new in approximately 2 hours without agitation at about 70° F. Rusted steel was tested as in Example 2 with equal results. It is believed that the formulation of Example 6 is preferred to the formulation of Example 1 since it has fewer ingredients and works as well.

EXAMPLE 7

A glass coffee pot with built-up scale and mineral deposits from boiling water was tested. The scale was ⅛ inch thick in spots and could not be removed with an SOS pad. The scale was removed in less than 1 minute after the formulation of Example 6, heated to about 180°–190° F., was introduced and swirled about.

Although the preferred embodiments of this invention have been shown and described, it is understood that various modifications and replacements of the components and methods may be resorted to without departing from the scope of the invention as disclosed and claimed herein.

What is claimed is:

1. A rust, corrosion, and scale removing composition for use in removing rust, corrosion, and scale, said composition consisting essentially of an additive concentrate and water, said additive concentrate consisting essentially of, on a parts by weight basis, 1.5 to 5 parts glycolic acid, 0.2 to 1 parts tetrasodium salt of ethylenediaminetetraacetic acid, 2 to 6 parts citric acid, and 1 to 3 parts trisodium citrate dihydrate, said composition being an aqueous solution., said composition being free from the presence of toxic chemicals listed in the EPA SARA Title III, Sec. 313 toxic chemical list (40 CFR 372.65, Jul. 1, 1993 Ed.).

2. The composition of claim 1, said composition consisting essentially of from about 5 to about 15 weight percent of said additive concentrate and from about 85 to about 95 weight percent of water.

3. The composition of claim 1, said composition consisting essentially of from about 0.2 to about 1.5 weight percent of said additive concentrate and from about 98.5 to about 99.8 weight percent of water.

4. The composition of claim 1, wherein said additive concentrate further consists essentially of, on a parts by weight basis, 0.5 to 1.5 parts dibasic ammonium citrate.

5. The composition of claim 1, wherein said additive concentrate consists essentially of, on a parts by weight basis, about 2.8 parts glycolic acid, about 0.4 parts tetrasodium salt of ethylenediaminetetraacetic acid, about 4 parts citric acid, and about 2 parts trisodium citrate dihydrate.

6. The composition of claim 1, wherein the pH is between about 2.5 and about 5.5.

7. A method of removing a corrosion product from a metal surface, said metal being selected from the group consisting of ferrous metal, copper, brass, and bronze, said method comprising contacting said corrosion product with a composition for an effective period of time to remove said corrosion product, said composition consisting essentially of an additive concentrate and water, said additive concentrate consisting essentially of, on a parts by weight basis, 1.5 to 5 parts glycolic acid, 0.2 to 1 parts tetrasodium salt of ethylenediaminetetraacetic acid, 2 to 6 parts citric acid, and 1 to 3 parts trisodium citrate dihydrate, said composition being an aqueous solution, said composition being free from the presence of toxic chemicals listed in the EPA SARA Title III, Sec. 313 toxic chemical list (40 CFR 372.65, Jul. 1, 1993 Ed.).

8. The method of claim 7, wherein said metal surface is a ferrous metal surface and said corrosion product is rust.

9. The method of claim 7, wherein said additive concentrate further consists essentially of, on a parts by weight basis, 0.5 to 1.5 parts dibasic ammonium citrate.

10. The method of claim 7, said composition having a pH between about 2.5 and about 5.5 immediately prior to said contacting step.

11. A method of removing scale from a cooling system which comprises (a) draining any coolant from the cooling system; (b) adding to the cooling system a composition consisting essentially of an additive concentrate and water, said additive concentrate consisting essentially of, on a parts by weight basis, 1.5 to 5 parts glycolic acid, 0.2 to 1 parts tetrasodium salt of ethylenediaminetetraacetic acid, 2 to 6 parts citric acid, and 1 to 3 parts trisodium citrate dihydrate, said composition being an aqueous solution, said composition being free from the presence of toxic chemicals listed in the EPA SARA Title III, Sec. 313 toxic chemical list (40 CFR 372.65, Jul. 1, 1993 Ed.); (c) circulating said composition through the cooling system for an effective period of time to remove scale from the surfaces of the cooling system; and (d) removing from the cooling system the composition and the scale removed from the cooling system surfaces.

12. The method of claim 11, wherein said additive concentrate further consists essentially of, on a parts by weight basis, 0.5 to 1.5 parts dibasic ammonium citrate.

13. The method of claim 11, wherein said composition being added to the cooling system has a pH between about 2.5 and about 5.5.

* * * * *

UNITED STATES PATENT AND TRADEMARK OFFICE

CERTIFICATE OF CORRECTION

PATENT NO. : 5,468,303

DATED : November 21, 1995

INVENTOR(S) : Glenn C. Thomas, Sr.

It is certified that error appears in the above-indentified patent and that said Letters Patent is hereby corrected as shown below:

Column 3, line 26, "Without" should be --without--.

Column 4, line 40, "solution.," should be --solution,--.

Signed and Sealed this

Twelfth Day of March, 1996

*Attest:*

*Attesting Officer*

BRUCE LEHMAN

*Commissioner of Patents and Trademarks*